United States Patent [19]

Boros

[11] 4,363,177

[45] Dec. 14, 1982

[54] STYLE CONVERTIBLE FOOTWEAR

[76] Inventor: Leslie A. Boros, 7074 E. Aster Dr., Scottsdale, Ariz. 85254

[21] Appl. No.: 155,408

[22] Filed: Jun. 2, 1980

[51] Int. Cl.[3] ..... A43B 3/24; A43B 3/12; A43B 21/36

[52] U.S. Cl. ..... 36/101; 36/11.5; 36/42

[58] Field of Search ..... 36/100, 101, 11.5, 36 R, 36/41, 42 R

[56] References Cited

U.S. PATENT DOCUMENTS

| | | | |
|---|---|---|---|
| 2,178,025 | 10/1939 | Richter | 36/101 |
| 2,195,324 | 3/1940 | Brunmark | 36/42 |
| 2,388,744 | 11/1945 | Hoy | 36/11.5 |
| 2,431,868 | 12/1947 | Gilmour | 36/42 |
| 2,760,279 | 8/1956 | Jones et al. | 36/11.5 |
| 3,204,346 | 9/1965 | Lockard et al. | 36/101 |
| 4,219,946 | 9/1980 | Baum | 36/42 |

FOREIGN PATENT DOCUMENTS

| | | | |
|---|---|---|---|
| 1006262 | 4/1952 | France | 36/101 |

*Primary Examiner*—Patrick D. Lawson

*Attorney, Agent, or Firm*—Cahill, Sutton & Thomas

[57] ABSTRACT

Each of a plurality of readily detachably attachable heels and each of a plurality of readily detachably attachable uppers are selectively mounted upon a sole and offer a user the freedom of rapid facile changes in style of footwear.

24 Claims, 9 Drawing Figures

STYLE CONVERTIBLE FOOTWEAR

The present invention relates to footwear and, more particularly, to footwear convertible in style.

Good quality footwear is relatively expensive, which expense generally limits a user to a few standard styles. Accordingly, a user is usually unable to obtain exact or even close correlation between the footwear and the style of dress.

Many years ago, footwear was considered primarily as an article necessary to protect the feet with little consideration for style. Accordingly, durability for a period of years was of paramount importance. Since heels and soles do wear, these were periodically replaced by shoe makers.

With the awakening of a desire on the part of the public to wear shoes that were not primarily practical but practical and stylish, several dilemmas arose. First, persons of modest means could not afford to own a large number of pairs of footwear to meet varying styles of dress and activities. As a result of this existing desire on the part of a large segment of population, various types of footwear was designed which included replaceable or substitutable components. The following identified United States Patents are representative of various developments to date along these lines. U.S. Pat. No. 1,829,253 is directed to a cast metal removable heel having a push button lock and cooperating with a particularly configured base member attached to the sole. U.S. Pat. No. 3,079,709 is directed to a replaceable top lift having a blade spring lock for securing it to the lower portion of a heel body. U.S. Pat. No. 3,581,413 is directed to a replaceable heel having a spring lock. U.S. Pat. No. 3,782,010 is directed to a replaceable heel attached by means of a threaded member extending downwardly through the sole of the footwear. U.S. Pat. No. 3,797,136 is directed to footwear having detachably attachable various height heels secured by a rotatable multi-armed member cooperating with locking flanges.

In each of the above described devices, the configuration of the sole requires that any replacement heel be approximately the same height as that of the replaced heel or else the footwear will be extremely uncomfortable because the toe section of the sole will not locate the ball of the foot in supported contact with the ground surface. Additionally, some of the mechanisms illustrated are structurally insufficient to withstand the forces imposed by normal activities of the wearer.

Generally, the uppers of footwear have been considered as primarily decorative and secondarily of structural importance. The following United States Patents describe various detachable uppers for footwear to alter the style and/or color of the footwear. U.S. Pat. No. 2,438,711 illustrates a repleaceable complete upper maintained in place by a cord alternately engaging loops in the upper and the sole. U.S. Pat. No. 2,491,430 illustrates a complete upper detachably secured to the sole by a zipper. U.S. Pat. No. 2,552,943 illustrates a complete upper detachably attached to the sole by means of an enlarged edge longitudinally slidably disposed within an undercut groove. A similar arrangement is illustrated in U.S. Pat. No. 3,204,346.

The following United States Patents illustrate footwear having replaceable heels and uppers. U.S. Pat. No. 2,873,540 is directed to a replaceable heel attached by a single wood screw, which screw is questionably sufficiently robust for normal use. A toe piece upper is slidably disposed intermediate the main sole and an outer sole. U.S. Pat. No. 3,154,866 is directed to a sandal having a heel maintained in place by any of several configurations, each of which is of questionable sufficient robustness to serve the purposes intended. The straps of the sandal are each removably detachable by engaging eyelets within slots disposed internal to the sole. U.S. Pat. No. 3,686,779 illustrates various types of slide engaging members for retaining a removable heel and further slide members for retaining a toe piece upper.

While many of the footwear described in this last group of patents are unquestionably operable, considering the normal loads placed upon footwear, serious questions are raised as to the robustness of the attachment and locking members for the removable elements.

The present invention is directed to convertible footwear incorporating exchangeable heels and uppers firmly attachable to a sole in fixed positional relationship thereto with sufficient robustness to prevent dislocation during normal use.

It is therefore a primary object of the present invention to provide footwear convertible from one style to another.

Another object of the present invention is to provide footwear having a sole configuration which affords interchange of different height heels.

Yet another object of the present invention is to provide a mechanically robust mechanism for easily and simply detachably attaching a heel to a sole.

Still another object of the present invention is to provide convertible footwear which incorporates a releasable self-locking mechanism for attaching an upper to a sole.

A further object of the present invention is to provide a sole curved in elevation to accommodate different sized interchangeable heels while maintaining the ball of a user's foot in a comfortable position adjacent the surface being walked upon.

A yet further object of the present invention is to provide a mechanical lock for capturing the lateral exremities of a detachably attached upper at the sides of a sole.

A still further object of the present invention is to provide inexpensive footwear changeable in style and configuration.

These and other objects of the present invention will become apparent to those skilled in the art as the description thereof proceeds.

The present invention will be described with greater specificity and clarity with reference to the following drawings in which.

Figure 1:
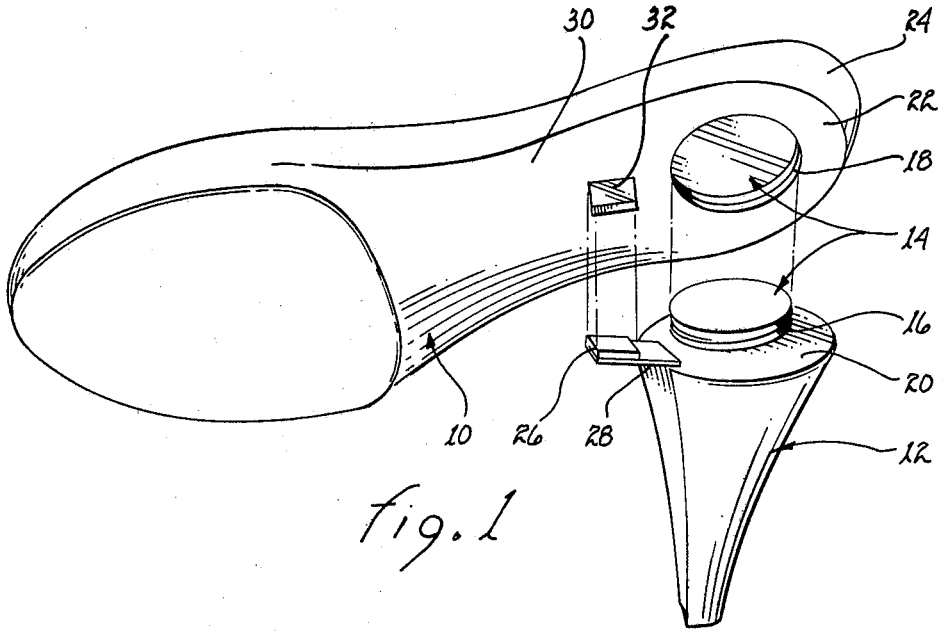
FIG. 1 is an isometric view of a convertible footwear.
Figure 2:
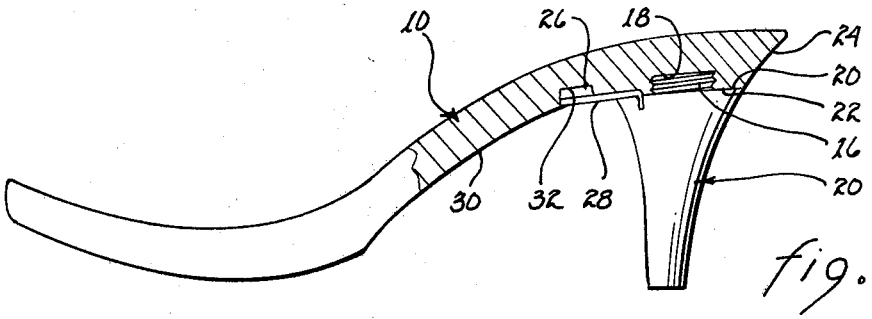
FIG. 2 is a partial cross-sectional view illustrating a mechanism for detachably attaching a heel to a sole.

Referring to FIGS. 1 and 2, there is shown a sole 10 of footwear which sole may be configured in elevation similar to that of a high heel shoe worn by many women. A detachably attachable heel 12 is secured adjacent the heel portion of sole 10 by lock means 14. The lock means includes a threaded stud 16 (preferably having a single turn) for threadedly engaging cavity 18 within the sole. A shoulder 20 extends lateral to the threaded stud for physically contacting surface 22 of the sole surrounding cavity 18 to provide lateral support and physical rigidity to the interconnection. For style purposes and aesthetic considerations, the curved outer surface of heel 12 should be configured to fair smoothly into the corresponding side surface 24 or edge of the sole.

Correspondence and positional integrity between the outer surface of heel 12 and the faired surface of the sole is maintained by preventing rotation of the heel with respect to the sole. Such anti-rotation means may include a male detent 26 mounted upon a spring member 28 extending forwardly of the heel adjacent underside 30 of sole 10. The male detent, after heel 12 is threadedly locked in place, is forced by spring means 28 into penetrable engagement with femal detent 32. Thereby, the detents must be disengaged before rotation of the heel with respect to the sole can be effected.

The size of stud 16 is selected to be only somewhat smaller than the circumference of shoulder 20, whereby maximum threaded area and circumference of the stud is achieved. The relative resulting massivness of the stud tends to provide a very strong mounting for the heel to prevent working and damage between the heel and the sole during normal use. Moreover, loosening of the threaded interconnection is precluded by the detents and yet, on command, the heel can be readily replaced.

Figure 3:
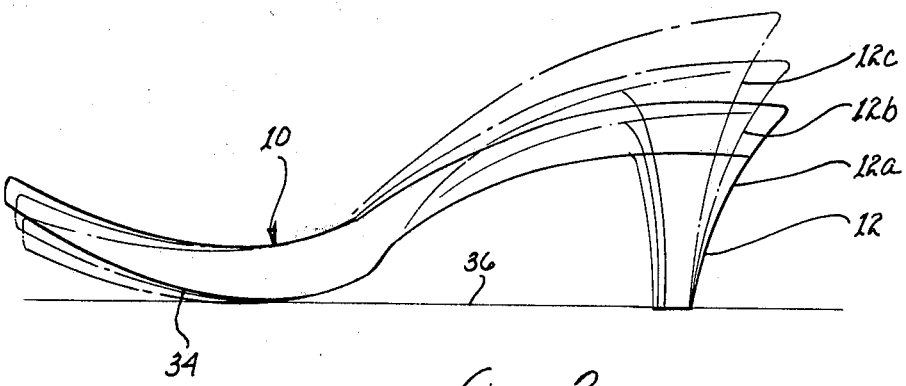
FIG. 3 illustrates the curvature in elevation of a sole to accommodate different heel heights.

Referring specifically to FIG. 3, the configuration of sole 10 which permits it to readily adapt to various height heels and yet maintain the ball of the user's foot proximate the ground will be described. Undersurface 34 of the front of the sole is curved in an arc, as illustrated in FIG. 2. The curvature of the arc, particularly in the area proximate the location of the ball of the user's foot, is curved so as to maintain at a minimum travel the point of tangency of undersurface 34 with the ground irrespective of which of different height heels 12 may be attached to the sole.

Three different heels 12*a*, 12*b* and 12*c* are illustrated in FIG. 3 to depict the resulting angular repositioning of sole 10. As may be noted from the figure, the point of contact of surface 34 with ground 36 is essentially the same or at least close enough such that no discomfort or awkwardness in walking results to the user. Because threaded cavity 18 (see FIGS. 1 and 2) remains the same in the sole, stud 16 extending from each of heels 12*a*, 12*b* and 12*c* must be angularly reoriented about the longitudinal axis extending through the heel in order for proper mating between the cavity and the stud and good contact intermediate shoulder 20 of the heel with the mating surface 22 of the sole to occur. These variations are primarily a matter of geometry and are readily determinable by one skilled in the art.

Figure 4:
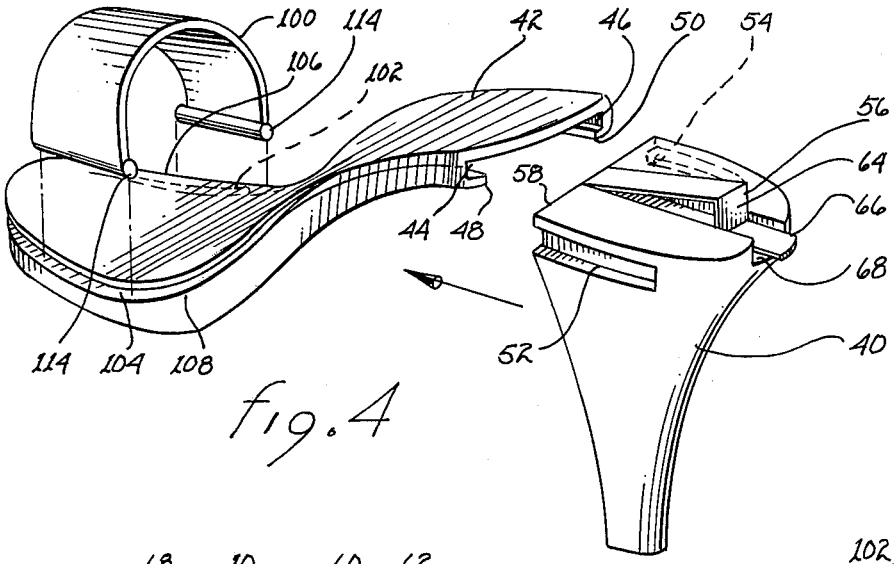
FIG. 4 illustrates another mechanism for attaching a removable heel and a removable upper to a sole.
Figure 5:
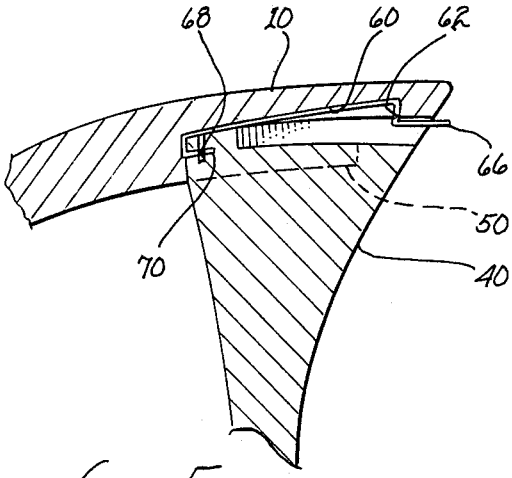
FIG. 5 is a partial cross-sectional view illustrating a heel in locking engagement with a sole.

Referring jointly to FIGS. 4 and 5, there is illustrated a variant of the lock means for detachably attaching a heel 40 to a sole 32. The sole includes a pair of longitudinally extending laterally oriented channels 44 and 46 having lower side walls 48 and 50. The heel includes a pair of laterally oriented slots 52, 54 for receiving side walls 48 and 50, respectively. The resulting interconnection is sufficiently rigid and robust to prevent rotation or lateral movement of the heel with respect to the sole.

To prevent unwanted longitudinal movement of the heel with respect to the sole, a spring detent 56 extends rearwardly and upwardly from leading edge 58 of the heel. The detent lockingly engages with a depression 60 formed within sole 10, as illustrated in FIG. 5. A lip 62 bears against step 64 of spring detent 56 to lock the heel in place. To remove the heel from the sole, tab 66 is depressed downwardly within slot 68 of the heel to disengage step 64 with lip 62. Thereafter, sliding rearward movement of the heel may be effected. Necessarily, the fore part of spring detent 56 must be firmly secured to the front of the heel. In example, means such as pin 68 may be employed to lockingly engage folded segment 70 of spring detent 56 with heel 40.

Figure 6:
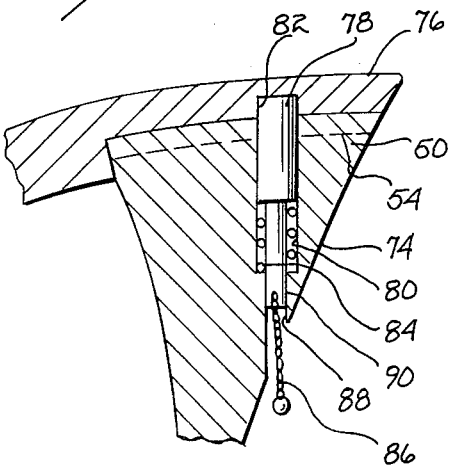
FIG. 6 is a partial cross-sectional view illustrating a yet further mechanism for locking a heel to a sole.

FIG. 6 illustrates a further variant of the locking means for retaining the heel attached to the sole as illustrated in FIG. 6. Heel 74 is secured to sole 76 in the manner illustrated in FIGS. 4 and 5; that is, slots, such as slot 54 is disposed within the heel for mating engagement with a side wall 50 attached to sole 76 (see also FIG. 4). The lock means includes a plunger 78 slidably nested within a conforming cavity 80 disposed in the heel. A depression 82 within sole 76 is configured to mate with the end of plunger 78 protruding thereinto. The resulting interlock precludes slidable disengagement of the heel from the sole.

As heel 74 is to be selectively detachable from the sole, plunger 78 is biased upwardly into engagement with depression 82 by spring means, such as coil spring 84. Retraction of the plunger from within depression 82 may be accomplished by a cord or chain 86 extending through a passageway 88, which passageway is in communication with cavity 80. To stabilize the spring within cavity 80, a shaft 90 may be disposed interior of the coil spring and intermediate plunger 78 and chain 86.

Figure 7:
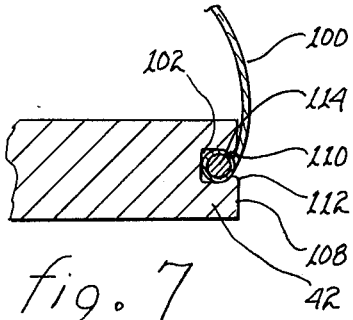
FIG. 7 is a partial cross-sectional view illustrating a lock mechanism for securing the lateral edges of an upper to a sole.

A detachably attachable upper 100 will be described with reference to FIGS. 4 and 7. Sole 42 includes a pair of laterally disposed grooves 102 and 104 formed within side walls 106 and 108 of the sole. These grooves, as illustrated with respect to groove 102 in FIG. 7, include lip retainers 110, 112 defining an opening into the groove which is of a smaller dimension than the groove itself.

Upper 100 includes cording 114 secured to the lower extremities thereof. It is to be understood that the upper itself may be formed so as to include such a bulbous termination at the extremities or other means may be similarly used. The size of cording 114 is selected to fit within groove 102 and yet be restrained from movement from therewithin by lip retainers 110 and 112. To instal the cording it may have to be compressed to squeeze it into place or the sole may be of resilient material to permit sufficient expansion for the cording to pass between the lip retainers. With this configuration of upper 100, it may be attached to or detached from sole 42 and yet be retained in place during normal use of the footwear.

Figure 8:
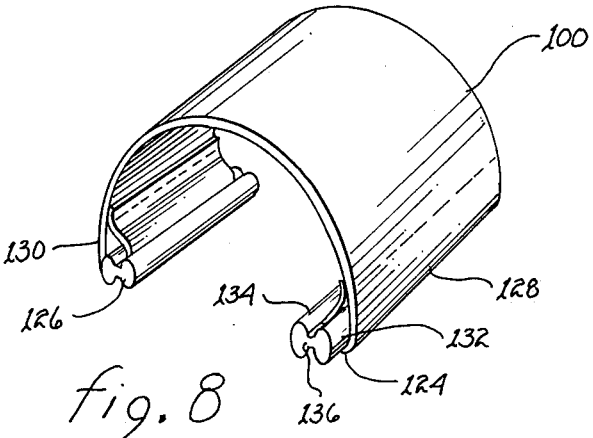
FIG. 8 is an isometric view illustrating an upper attachable to a sole.
Figure 9:
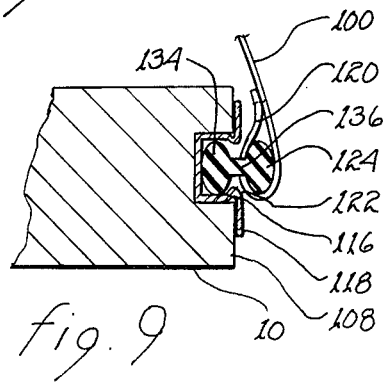
FIG. 9 illustrates a locking mechanism for securing the edges of an upper to a sole.

FIGS. 8 and 9 illustrates a variant of the means for retaining upper 100. Herein, the sole, such as sole 10, includes generally rectangular shaped grooves 116 disposed in each side wall (108). A spring clip 118 is nestably mounted within groove 116 and includes inwardly extending edges 120 and 122, which edges are proximate the opening to the groove.

A dual bar unit 124 and 126 is secured to each of extremities 128 and 130 of upper 100. Each dual bar unit includes a first bar 132 about which is wrapped the extremity 128 to secure the extremity to the dual bar unit 124. It is to be understood that an element other than a bar may be employed for attachment of upper 100. A second bar 134 is attached to bar 132 through lands 136, or the like, to maintain the two bars in fixed relation to one another. Bar 134 is configured to be nested within clip 118 and removal therefrom can only be accomplished by expansion of the clip to permit sufficient clearance between edges 120 and 122 to pass the bar therebetween. Other means having a bulbous element for engagement with clips 118 could also be used.

In operation, clip 118 is first brought into receiving engagement with bar 134. Thereafter, the clip is squeezed sufficiently to permit insertion thereof and the retained bar within groove 116. Withdrawal of bar 134 from within clip 118 is precluded by edges 120 and 122 as groove 116 prevents expansion of the clip sufficient to allow passage of bar 134 past the edges. The clip is retained within the groove by the inherent spring force of the clip bearing against the sides of the groove and the resulting frictional engagement precludes unwanted removal. To remove upper 100 from engagement with the sole, spring clip 118 is squeezed to permit its withdrawal from within the groove and thereafter bar 134 may be withdrawn from within spring clip. Thus, replacement of upper 100 is readily and easily effected and yet the upper will be retained in place during normal use of the footwear. Alternatively, the spring clip may be permanently attached to the groove and insertion and withdrawal of the bulbous end of the upper would be effected by expanding the clip within the groove to permit passage of the bulbous end past edges 120 and 122.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. Convertible footwear, said footwear comprising in combination:

(a) a sole;

(b) a replaceable heel;

(c) means for detachably attaching said heel to said sole, said attaching means comprising a threaded stud extending from the upper end of said heel and a threaded cavity disposed in said sole for receiving said stud, each said stud and said cavity including single turn threads for effecting attachment therebetween;

(d) means for locking said heel to said sole upon attachment to prevent inadvertent detachment of said heel, said locking means comprising a male detent and a female detent engageable with one another upon threaded engagement between said stud and said cavity, said male detent engaging said female detent upon one turn engagement of said stud with said cavity;

(e) a replaceable upper having opposed extremities;

(f) a channel disposed in each of the opposed sidewalls of said sole; and (g) means for releasably engaging one of the extremities of said upper with each of said channels.

2. Convertible footwear, said footwear comprising in combination:

(a) a sole;

(b) a replaceable heel;

(c) means for detachably attaching said heel to said sole, said attaching means comprising a threaded stud extending from the upper end of said heel and a threaded cavity disposed in said sole for receiving said stud;

(d) means for locking said heel to said sole upon attachment to prevent inadvertent detachment of said heel, said locking means comprising a male detent and a female detent engageable with one another upon threaded engagement between said stud and said cavity;

(e) a replaceable upper having opposed extremities;

(f) a channel disposed in each of the opposed sidewalls of said sole; and (g) means for releasably engaging one of the extremities of said upper with each of said channels, said engaging means comprising a bulbous element disposed at each extremity of said upper and, each said channel including a lip for retaining said bulbous end within said channel, said bulbous element comprising cording.

3. The footwear as set forth in claim 1 wherein said channel includes a removable spring clip for gripping said bulbous element, said channel being configured to nestingly receive said spring clip to prevent release of said bulbous element from within said spring clip.

4. The footwear as set forth in claim 3 wherein said spring clip includes retaining lips for capturing said bulbous element.

5. The footwear as set forth in claim 4 wherein said bulbous element includes a dual bar unit having a first bar secured to an extremity of said upper, a second bar capturable by said spring clip and means for maintaining said first and second bars adjacent one another.

6. The footwear as set forth in claim 5 wherein the bottom surface of the forward part of said sole is convexly arced.

7. The footwear as set forth in claim 1 wherein said attaching means comprises a pair of grooves disposed in opposed sides of said heel and a sidewall extending inwardly from each opposed side of said sole for engaging one of said grooves.

8. The footwear as set forth in claim 7 wherein said locking means comprises a stepped spring detent and a lip for engagement therewith upon mating of said heel with said sole.

9. The footwear as set forth in claim 8 wherein said engaging means comprises a bulbous element disposed at each extremity of said upper.

10. The footwear as set forth in claim 9 wherein each said channel includes a lip for retaining said bulbous end within said channel.

11. The footwear as set forth in claim 10 wherein said bulbous element comprises cording.

12. The footwear as set forth in claim 9 wherein said channel includes a removable spring clip for gripping said bulbous element, said channel being configured to nestingly receive said spring clip to prevent release of said bulbous element from within said spring clip.

13. The footwear as set forth in claim 12 wherein said spring clip includes retaining lips for capturing said bulbous element.

14. The footwear as set forth in claim 13 wherein said bulbous element includes a dual bar unit having a first bar secured to an extremity of said upper, a second bar capturable by said spring clip and means for maintaining said first and second bars adjacent one another.

15. The footwear as set forth in claim 14 wherein the bottom surface of the forward part of said sole is convexly arced.

16. The footwear as set forth in claim 7 wherein said locking means comprises a spring loaded plunger disposed in said heel and a depression disposed in said sole for receiving said plunger upon mating of said heel with said sole.

17. The footwear as set forth in claim 16 wherein said engaging means comprises a bulbous element disposed at each extremity of said upper.

18. The footwear as set forth in claim 17 wherein each said channel includes a lip for retaining said bulbous end within said channel.

19. The footwear as set forth in claim 18 wherein said bulbous element comprises cording.

20. The footwear as set forth in claim 17 wherein said channel includes a removable spring clip for gripping said bulbous element, said channel being configured to nestingly receive said spring clip to prevent release of said bulbous element from within said spring clip.

21. The footwear as set forth in claim 19 wherein said spring clip includes retaining lips for capturing said bulbous element.

22. The footwear as set forth in claim 21 wherein said bulbous element includes a dual bar unit having a first bar secured to an extremity of said upper, a second bar capturable by said spring clip and means for maintaining said first and second bars adjacent one another.

23. The footwear as set forth in claim 22 wherein the bottom surface of the forward part of said sole is convexly arced.

24. Convertible footwear, said footwear comprising in combination:

(a) a sole having opposed sidewalls;

(b) a replaceable upper having opposed extremities;

(c) means for detachably attaching each extremity of said upper to one of the sidewalls of said soled, said attaching means including and being limited to first engaging means associated with each extremity of said upper and second engaging means associated with each sidewall of said sole for precluding relative movement between the extremities of said upper and the sidewalls of said sole in a direction parallel to the plane of the respective one of the sidewalls; and (d) said first and second engaging means including press fit means for attaching and detaching each extremity of said upper to one of the sidewalls of said sole only by direct and essentially orthogonal movement toward and away, respectively, from the plane defined by the respective one of the sidewalls.

* * * * *